United States Patent [19]

Fry

[11] Patent Number: 4,585,014

[45] Date of Patent: Apr. 29, 1986

[54] FIRE INHIBITING TUBULAR SAFETY SHIELD FOR A CIGARETTE TYPE SMOKING DEVICE AND COMBINATION THEREOF

[76] Inventor: Arnold H. Fry, 3182 Grey Fox Dr., Gahanna, Ohio 43230

[21] Appl. No.: 519,527

[22] Filed: Aug. 1, 1983

[51] Int. Cl.[4] ..... A24D 1/02; A24D 1/12

[52] U.S. Cl. ..... 131/175; 131/187; 131/224; 131/257; 131/260

[58] Field of Search ..... 131/174, 175, 187, 224, 131/260, 257

[56] References Cited

U.S. PATENT DOCUMENTS 2,454,631 11/1948 Chneerson et al. ..... 131/175

2,499,733 3/1950 Di Rubbio ..... 131/175

*Primary Examiner*—V. Millin

*Attorney, Agent, or Firm*—Robert E. Stebens

[57] ABSTRACT

A smoking device is provided having a tubular safety shield to inhibit the ability of a rod-like smoking tobacco element from igniting other articles with which the device may come into contact. The safety shield includes a multiplicity of projections that extend relatively inward to engage with a tobacco element and support it in coaxially spaced relationship to the wall of the tubular shield, thereby resulting in an annular chamber enabling essentially uninhibited and free circulation of air. Forming of the projections results in the concurrent formation of the like number of apertures in the shield wall with these apertures effectively disposed to face in a generally axial direction relative to the longitudinal axis of the shield while enabling free airflow.

15 Claims, 4 Drawing Figures

FIRE INHIBITING TUBULAR SAFETY SHIELD FOR A CIGARETTE TYPE SMOKING DEVICE AND COMBINATION THEREOF

FIELD OF THE INVENTION

This invention relates in general to tobacco smoking devices and relates more specifically to a tubular safety shield for cigarette type smoking devices for reducing the likelihood of the device causing a fire when not properly disposed of. It relates in particular to a tubular safety shield which can be integrally combined with a cigarette type tobacco element to provide a protective non-combustible shield around the cigarette or other similar type of smoking device.

BACKGROUND OF THE INVENTION

Smoking of tobacco, particularly in the form of cigarettes is a widespread practice which, while providing pleasure and satisfaction to the smoker, presents a substantial hazard in the form of fire. While the fire hazard is not a significant problem when smokers exercise a proper degree of care in the smoking of cigarettes and disposal of the ash and resulting residue, however, experience has shown that substantial carelessness is found among smokers. Consequently, efforts have been made in particular to improve fire safety with respect to smoking of cigarettes, although attempts have also been made to improve safety with respect to cigar and pipe smoking. The area of safety with which this invention is primarily concerned is safety relative to smoking of cigarettes, although the invention is not deemed limited to that specific type of tobacco material.

Predominant causes of fires as a consequence of smoking cigarettes are the careless and inadvertent dropping of burning cigarettes onto or into combustible materials and improper disposal of ashes and the butts which are not fully extinguished at the time of disposal. Burning cigarettes frequently fall from ashtrays where they are temporarily placed during the course of the smoking and drop onto furniture and carpets. Even if the cigarettes that drop do not result in igniting the materials or objects upon which they land, they invariably at least cause damage to the article such as by scorching, thereby producing burn marks. Fires are also frequently caused by careless tossing of a burning cigarette into an improper container such as a trash can containing highly combustible material such as paper or other similar types of materials. Another major cause of a substantial number of fires as a consequence of careless smoking habits is the smoking by persons who inadvertently fall asleep while lying or sitting up in bed as well as sitting in a chair. Invariably, the cigarette falls from the person's hand and drops onto floor carpeting or the upholstered material of a chair or the highly combustible bed clothes in the case of those who smoke in bed.

Prior efforts to eliminate the fire hazard associated with smoking of cigarettes have primarily centered on providing of a container-type shield into which a cigarette is placed during the course of smoking. One example of such a device is illustrated in U.S. Pat. No. 2,454,631 issued to Z. Chneerson on Nov. 23, 1948. That patent illustrates a typical device which comprises an elongated tubular container which contains the cigarette and is provided with a mouthpiece to enable smoking. The cigarette is physically restrained and supported in a coaxial position within the elongated container and has the one end coupled with the mouthpiece. A number of apertures are formed in the wall of the container to permit airflow necessary to effect combustion. Another example of a container type of device is that disclosed in U.S. Pat. No. 2,625,163 granted to R. F. Jones on Jan. 13, 1953. The Jones structure again includes an elongated container provided with a mouthpiece at one end. The container, as in the case of the Chneerson unit is provided with elements to support the cigarette in fixed, coaxally spaced relationship to the walls of the elongated container and to hold the cigarette at one end in association with the mouthpiece to enable smoking. Again, apertures are formed in the container wall to permit airflow for purposes of enabling combustion. While Chneerson provides a number of apertures distributed throughout the entire length of the chamber containing the cigarette, Jones provides apertures only at each of the extreme ends of the container. Also, while Chneerson provides a number of spring fingers on the interior of the chamber to provide support for the cigarette and to also function in knocking off the ash as it accumulates during the course of burning, Jones provides a number of small lugs that extend from the interior of the chamber into supporting contact with the cigarette. Each of these two examples characterized also by a relatively large physical structure. As a consequence, the safety devices as exemplified by either of Chneerson's or Jones' structures are cumbersome to utilize as well as being relatively expensive to fabricate. Such devices have not been accepted by smokers, and thus, there remains a need for a safety smoking device to perform the desired safety functions.

More recent efforts in providing safety devices for cigarettes are exemplified in U.S. Pat. No. 4,289,149 issued to Kyriakou on Sept. 15, 1981 and U.S. Pat. No. 3,886,954 issued to Hannema on June 3, 1975. Each of these two patents disclose structures which are substantially smaller in physical size as compared to the Jones and Chneerson type structures. Each of the Kyriakou and Hannema patents utilizes a double-walled tubular shield structure with the two walls coaxially disposed to each other, thus forming an annular chamber to provide protection against direct contact with the cigarette and to reduce the likelihood of heat being transferred from the cigarette through the device to any material or structure on which the cigarette and its container may be placed. Kyriakou provides a container having a number of apertures formed throughout the extent of the container walls to permit airflow with respect to the cigarette. For support of the cigarette, Kyriakou only provides a single ring which engages with the cigarette approximately at its midpoint with the ring being carried by the inner cylindrical wall.

Hannema, while having a double walled structure, differs from Kyriakou in that it does not include the conventional type of mouthpiece as the double-walled tube is formed such that one end of the tube functions as a mouthpiece. Hannema provides a structure which is self-contained to permit smoking and is deemed to be a disposable throwaway type of unit as contrasted to the more general type of device which is designed to enable replacement of cigarettes within the chamber itself with the device thus being reusable. The double-walled tubular structure of Hannema is provided with end caps at each end and provided with apertures to permit airflow to the cigarette through one end cap and from the cigarette through the cap at the other end functioning as a mouthpiece. Additionally, apertures and passageways are provided in the double walled structure to permit airflow through the cylindrical wall with respect to the cigarette. The outer wall is provided with apertures permitting airflow relative to the annular chamber and the inner wall carries a number of projections which provide support for maintaining the cigarette in coaxally spaced relationship to the inner wall with each of those projections also being formed with a passageway to permit the airflow relative to the annular chamber between the two walls and the cigarette itself. These passageways are blocked by the cigarette until such time as the cigarette has burned and produced an ash which will not necessarily obstruct the airflow to those passageways. However, smoke will also intermix with air in the annular chamber as it cannot readily escape, thereby resulting in a reduced oxygen content with consequently inhibited combustion of the tabacco, thus producing a greater quantity of the undesirable combustion products deemed a health hazard. While these structures of Kyriakou and Hannema provide a degree of protection against inadvertent igniting of combustible materials upon which they may be placed, the devices have not been employed. One of the apparent reasons such devices have not been employed is that the double-walled structure is difficult to form and represents a substantial expense and significantly inhibits airflow, thereby resulting in relatively poor combustion of the tobacco with a consequent increase in production of the undesirable solid combustion products.

SUMMARY OF THE INVENTION

In accordance with this invention, a safety shield is provided for use with cigarettes or similar rod-like smoking elements with the shield adapted to be incorporated as an integral part of a smoking device or used as a separate unit into which cigarettes are inserted for smoking. Formed as an integral part of a cigarette type of smoking device, the shield is fabricated as a disposable unit. The construction of the shield itself which comprises a relatively thin walled, cylindrical tube is sized to be only slightly larger than the cigarette smoking element itself, thus resulting in a very compact device which does not have the undesirable physical bulk of many of the devices previously provided for this purpose.

The tubular shield provided in accordance with this invention for receiving a cigarette is of a single wall construction which enhances economy of manufacture. Although there is only a single wall, the shield employs a unique structural design that is highly effective in providing the desired protection in containing a burning cigarette and the resulting ashes as well as providing protection against transfer of heat from the burning cigarette through the wall of the shield. This structural design also does not inhibit airflow relative to the cigarette, thereby enabling the highly desired more complete combustion of the tobacco.

The tubular shield of this invention is formed from a thin non-combustible material, such as a metal foil, which has the necessary structural strength characteristics. When formed into a cylindrical tube, the thin foil has sufficient structural strength as to be self-supporting even when subjected to the relatively high combustion temperatures of the tobacco. A large number of small apertures are formed throughout the length of the shield that is coextensive with the portions of the cigarette that are normally burned and it is also provided with a large number of small projections to support the cigarette in spaced relationship to the interior wall of the shield. The unique structure of the shield of this invention permits a substantially uninhibited airflow through the shield, and thus, the combustion process is thus not adversely affected by the shield. Air undiluted by smoke is permitted to freely flow inwardly to not only provide sufficient oxygen for proper combustion of the tobacco, but minimizing the generation of undesirable solid combustion products. This relatively free airflow throughout the length of the shield has the further important advantage of enhanced cooling of the shield. In this illustrative embodiment, the apertures are concurrently formed with the formation of the projections resulting in a supporting projection at each of the apertures. The projections are relatively small and have a relatively small surface area in contact with the cigarette and in particular, with respect to the burning portions thereof. As a consequence of this small contact surface, there is a minimal ability for transfer of heat to the shield. Additionally, by forming the shield from a metal which has a high coefficient of conduction for heat, the heat that is transmitted to the shield will be readily dissipated throughout the shield and thus minimize the temperature of the shield at its exterior surface.

These and other objects and advantages of this invention will be readily apparent from the following detailed description of illustrative embodiments thereof and the accompanying drawings.

DESCRIPTION OF THE DRAWING FIGURES

DESCRIPTION OF THE ILLUSTRATIVE EMBODIMENTS

Figure 1:
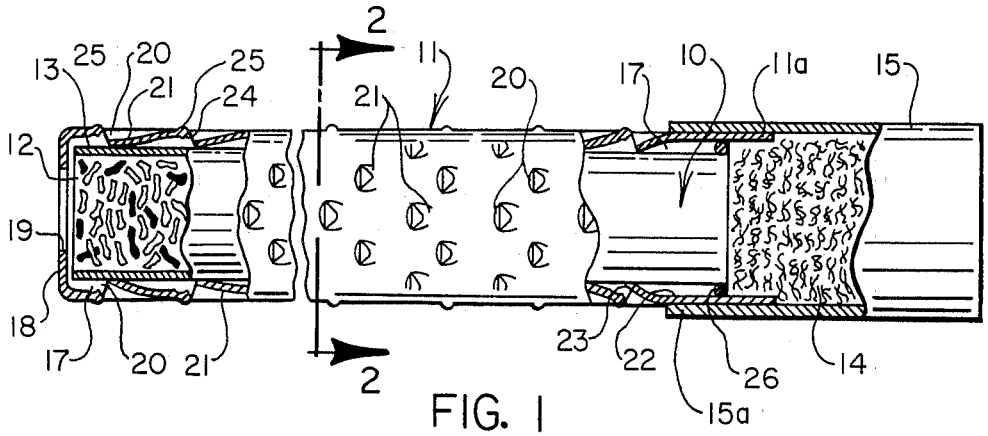
FIG. 1 is an elevational view of a cigarette embodying this invention having portions thereof broken away for clarity of illustration.
Figure 2:
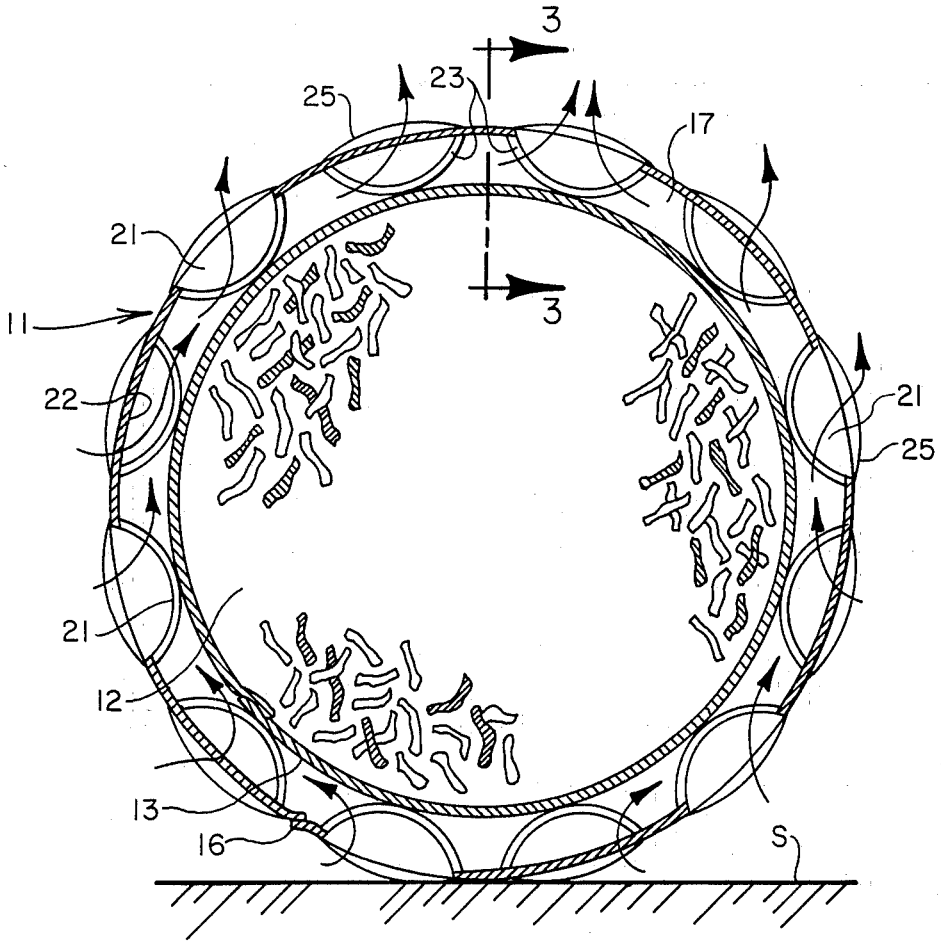
FIG. 2 is a sectional view on a substantially enlarged scale taken along line 2—2 of FIG. 1.
Figure 3:
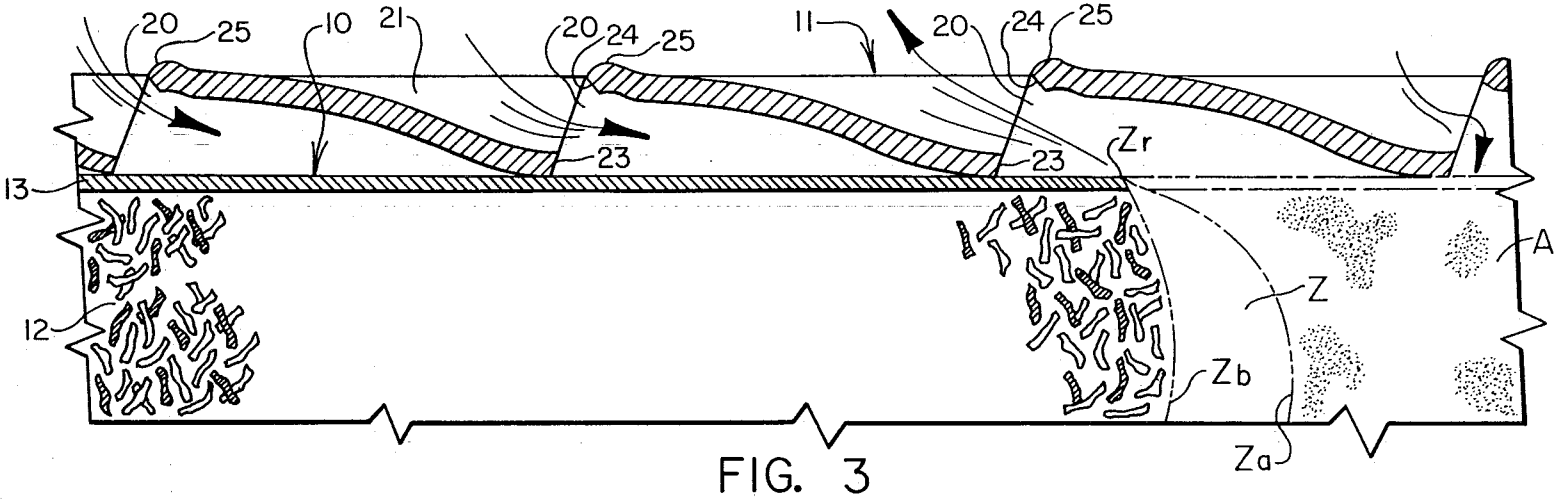
FIG. 3 is a fragmentary sectional view on a further enlarged scale taken along line 3—3 of FIG. 2.

Having reference to FIGS. 1, 2 and 3 of the drawings, an embodiment of the invention is illustrated which is designed to be formed as an integral part of the cigarette and is thus of a disposable type. This embodiment includes a rod-like tobacco element 10 which is of a conventional cigarette type and is provided with a protective shield 11 fabricated in accordance with this invention. The tobacco element 10 includes an elongated rod of tobacco 12 which is encased within and contained by a tubular sheath 13. This tubular sheath is fabricated from a combustible material such as the conventional cigarette paper. Additionally, the tobacco element 10 includes a filter element 14. This filter element 14 is fabricated in a conventional manner as is the cylindrical tobacco element and is positioned in axially extending relationship to one end of the rod of tobacco 12. An exterior sheath 15 formed from a thin paper-like material is wrapped around the material forming the filter element 14 and forms a mouthpiece as well as structurally interconnecting the components.

The protective shield 11 is formed from a thin sheet of material such as a suitable metal which is non-combustible and has the necessary structural strength. An elongated cylinder is produced from a sheet of suitable material by forming it around a tobacco element with a longitudinal seam 16 formed by overlapping marginal edge portions of the sheet material resulting in a structurally strong tube. If desired for greater structural strength and rigidity, these overlapped edges of the seam may be secured together as by a suitable adhesive or by mechanical interlock crimping of those edges. The shield 11 is of a length that is substantially equal to the length of the rod of tobacco 12 and is formed with a diameter that is slightly larger than the exterior of the tubular paper sheath 13 of the cigarette. As a consequence, the shield when coaxially positioned relative to the tobacco element thus forms an annular space or chamber 17 extending the full length of the rod of tobacco. One end of the shield 11 has a marginal end portion 11*a* extending a distance over an end portion of the filter element 14 in overlapped relationship. This sheath 15 extends not only over the marginal end 11*a* of the shield, but has its own marginal end portion 15*a* extending over an end portion of the shield beyond the end of the filter element 14 and to which it may be mechanically secured as by means of a suitable adhesive. This construction enhances the structural integrity of the device and has the advantage of maintaining the shield 11 and filter element as an integral unit even if the tobacco element may burn completely up to the filter element. It will be noted that the shield in combination with the enclosed rod of tobacco has a total diameter which is essentially equal to that of the filter element. As a consequence, the unit has a substantially uniform diametrical size which can be conveniently made of the same dimension as a conventional size cigarette.

The end of the shield 11 remote to the filter 14 is essentially open. Leaving the end of the tubular shield open, enables the cigarette tobacco to be readily ignited, but as will be explained in greater detail, does not result in the ash that is formed from combustion falling out of the open end as a consequence of normal usage. However, it is advantageous to form this end of the shield 11 with an inturned lip 18. This lip 18 thus forms an annular ring having a radial width sufficient to result in its inner circular edge 19 extending a slight distance radially inward of the outer periphery of the rod of tobacco 12. This lip 18 may be readily formed by turning a marginal end portion of the shield inwardly during the fabrication of the device.

Formed in the wall of the shield 11 are a relatively large number of small apertures 20 which readily permit inflow of air to the cigarette for purposes of combustion and the exhaust of gaseous combustion products. The air and gas flow will be explained in further detail. Also integrally formed with the shield are a large number of projections 21. These projections are integrally formed from the sheet of material forming the shield and extend a distance inwardly to contactingly engage with the tubular sheath 13 surrounding the tobacco 12. These projections which are distributed throughout the interior of the shield thus support the tobacco element 10 in spaced relationship to an inner wall surface 22 of the shield, thus resulting in the formation of the annular chamber 17. Fabrication of the shield may be readily accomplished by passing a sheet of the material between a pair of forming rolls having appropriately configured surfaces. For this purpose, the forming rolls may be provided with cooperating projections and depressions on their outer surfaces which correspond with the shape of the projections 21 that are desired to be formed in the shield. As can be seen from the drawings, these projections 21 in the illustrative embodiment have a scoop shape and are formed as a consequence of deforming the wall of the shield by pushing the projections relatively inward of the one surface and concurrently forming the apertures 20. Each projection 21, as can be seen in FIG. 2, has an inwardly inclined, channel-shaped configuration with a terminal edge 23 of semicircular shape resulting in only a small surface portion thereof contacting with the tobacco element 10. This construction thus results in only a small contact surface area through which heat may be transferred from the burning portions of the cigarette to the shield itself. This minimal contact of the projections minimizes the heat that is transferred and by forming the shield from a material which has a high coefficient of heat conduction, heat that is thus transferred will be readily dissipated throughout the remainder of the shield and utilmately transferred to the surrounding atmosphere at a relative rapid rate due in part to enhanced cooling resulting from the relative free circulatory airflow throughout the entire length of the shield.

During a rolling operation for forming of the projections 21 in a sheet of material from which a shield 11 is to be fabricated, the deformation of the material results in the simultaneous forming of the apertures 20 with formation of the terminal edge 23 of the projection. It will be noted that this fabrication technique thus results in the apertures 20 being essentially disposed in a plane that is perpendicular to the plane of the sheet of the material or, when the sheet is formed into the tubular shield, being relatively radially disposed. To further illustrate the dimensioning of the projections as well as the size of the apertures, it will be noted that in this embodiment those projections have a transverse width at their edge 23 of the order of 1 millimeter. Each projection has a longitudinal length that is of the order of two millimeters and each has a depth of the order of ½ millimeter. A large number of the projections 21 are thus formed along with the associated apertures 20 and these may be arranged as illustrated in symmetrical longitudinally extending rows and in radial alignment. It will be noted that the projections 21 and apertures 20 in adjacent longitudinal rows are arranged in an offset pattern.

Formation of the projections 21 as described results in the aperture 20 having a small area that is oriented parallel to the plane of the shield with the major portion of the apertures transversely or radially oriented. Minimizing the aperture area that lies in the plane of the wall of the shield will minimize the direct heat radiating paths and thereby reduce heat transmission to surrounding objects. It will also be noted that this fabrication technique wherein the projections are struck from a sheet of material and that sheet is then subsequently rolled into a cylinder results in forming of a slightly inturned lip 24 extending across the aperture. This lip 24 is also slightly raised with respect to the outer surface of the shield and thus forms an outwardly projecting rib 25 at each aperture. An advantage of this rib 25 which is thus formed is that it thus presents a small surface area which will be capable of direct contact with any material that is brought into association with the cigarette or any surface upon which the cigarette may be positioned. This is of importance in that it further reduces the contact area through which heat may be transmitted to any such material, and thus, there is a further reduction in the likelihood of a burning cigarette causing other materials to be ignited. It will be noted that the burning zone of the tobacco element is of relatively small longitudinal extent and thus there is only a small annular ring which is subjected to the heat of combustion at any given time. If desired to obtain a greater sized rib 25, the forming dies or rolls may be appropriately configured to perform that function. The advantage of having the outwardly projecting rib 25 can be seen in FIG. 2 which diagrammatically illustrates the smoking device positioned on a flat surfaces such as a table top. It can be readily seen from the drawing figures and particularly by reference to the sectional view of FIG. 3 that even though there are several such ribs 25 that will contact the surface, there is only a small total contact surface between the smoking device and the table top surface S. A further advantage of the structure is that since heat tends to rise, there will be an induced airflow under the bottom surfaces of the smoking device and into the interior thereof through those apertures facing generally downwardly. This flow of the air into the annular chamber 17 results in cooling of the adjacent portions of the shield and thereby effects a further reduction in the amount of heat that would be likely to transfer through the shield to a supporting surface such as a table top.

As to the combustion of the tobacco element, it will be noted that the large number of apertures enable air to flow into the interior of the chamber 17 and to flow either longitudinally of the tobacco element or to flow circumferentially around the element to the point of combustion. This airflow is diagrammatically illustrated in FIGS. 2 and 3. Because of the relatively free airflow in the annular chamber 17, it may be desirable to provide a seal 26 at the end of the chamber adjacent the end face of the filter element 14 to prevent the possibility of air being drawn through the filter from the chamber rather than through the rod of tobacco. The seal 26 may be formed from adhesive such as that which may be used to connect the shield and filter element.

The interaction of the airflow and gaseous combustion products is diagrammatically illustrated in FIG. 3 where a typical tobacco burning zone Z is indicated. The burning zone with the highest temperatures is of a relatively short length and because of its general conical shape indicated by the lines Za and Zb has a very small annular ring portion $Z_R$ of combustion at the extreme outer surface of the rod of tobacco and its enclosing sheath 13. This annular ring of burn $Z_R$ at the surface of the tobacco element is of a very short longitudinal length and is essentially less than the spacing between adjacent longitudinally aligned projections 21. As a consequence, there is a tendency for air to flow inwardly of the apertures 20 in a direction toward the point of burning and from both sides of the point of burning to better enable combustion. Because of the large number of apertures 20 that are formed in the wall of the shield 11, there is an ample supply of air to effect combustion in a normal manner as with a cigarette which is not provided with the protective shield 11 of this invention, and thus, the shield of this invention does not adversely affect the smoking function. There is sufficient airflow such that it is not necessary to periodically inhale through the cigarette to maintain combustion as would be the case where there is an insufficient number of apertures to permit inflow of an adequate quantity of air.

Gaseous combustion products generated at the burning zone, if not inhaled through the cigarette through the smoking process, can readily exhaust through the apertures. There is a relatively short path for the combustion products to travel and they can flow circumferentially around the cigarette and exit through any of the apertures 20 which are effectively opening upwardly to take advantage of the convective current flow. As the point of burning traverses a particular aperture, the gaseous combustion products will normally assume the predominant flow path through that aperture and thus effectively inhibit inward airflow. However, as soon as the burning point passes an aperture, inward airflow will then again resume.

Burning of the tobacco element will progress in an essentially normal pattern associated with a cigarette which is not provided with the protective shield 11. At a point where the burning occurs adjacent the end next to the filter element 14, the burning will tend to terminate due to a smaller quantity of air being available. A smaller quantity of air being available for combustion results from the overlapping extension 15*a* of the exterior sheath 15 that covers the filter and extends a distance over the terminal end of the shield 11. Without any apertures for entrance of air at this particular point, there is a significant reduction in the available air and the fire is likely to self-extinguish. This automatic extinguishing of the burning tobacco is based on the initial assumption that the smoker is not inhaling through the filter when the burning zone enters this region.

A further advantage of the configuration of the projections 21 is that they also function to reduce the amount of solid combustion products that are exhausted to the environment. As previously noted, the shield 11 is cooled as a consequence of its ability to conduct heat which is in conjunction with the cooling effect of the circulatory air currents through the apertures 20 and the annular chamber 17. This cooling of the shield which will tend to remain at a temperature less than that of the gaseous combustion products as they are produced, results in the shield causing some of these combustion products to condense on the inwardly facing surfaces of the shield as they flow outwardly from the shield. This function of the shield is of particular advantage in that a portion of the undesirable nicotine tars and other products will be collected for disposal rather than merely exhausted into the environmental atmosphere where they may be ingested by others. This function is particularly beneficial when a burning cigarette is merely placed in an ashtray.

Another advantage of the configuration of the shield 11 and its projections 21 is that they tend to enhance the combustion process. Heat generated by combustion of the tobacco will radiate outwardly, but a portion of this radiated heat incident to the inwardly facing surfaces of the shield and projections will tend to be reflected back into the burning zone Z. The result is that higher average temperatures are maintained in the burning zone and tends to produce more complete burning of the tobacco, thereby effecting a reduction in the amount of undesirable combustion projects that would otherwise be produced. Orientation of the projections 21 with respect to the direction of burning is deemed advantageous in obtaining a more complete burning of the tobacco.

The projections 21 that are formed on the interior surface of the shield 11 function not only to support the unburned tobacco element 10 in proper relationship to the shield, but they also serve to maintain the resulting ash A in a cylindrical form. The ash, as it is formed from combustion of the tobacco, will essentially maintain itself in a solid configuration, although of a very fragile nature. The ash particles retain the general configuration of the tobacco particles from which they are formed, and thus produce an interlocking matrix that is composed of the ash. This ash residue tends to retain its cylindrical configuration and is supported by the non-resilient projections 21. Thus, the ash will be retained within the interior of the shield 11 even though the end is open and perhaps only partially closed by the inturned lip 18. The ash though is very fragile and, if desired, it is possible to discharge the ash at intervals by holding the cigarette in a generally vertical orientation and lightly tapping the shield. This will cause sufficient vibration to break up the interlocking ash matrix and permit the ash to then disintegrate into individual particles that will merely drop out of the open end of the shield. However, the structural strength of the ash matrix is generally sufficient that during normal smoking without any significant physical jarring, the ash will be retained within the shield. The shield thus also performs the function of an ash container which can be used to retain the ash until the cigarette is entirely consumed. At that point, the shield 11 which is of a relatively thin walled nature can be readily collapsed by pinching the end of the shield and thereby form a substantially closed container for disposal of the ash along with the other components of the consumed cigarette.

The effectivity of the protective shield 11 in combination with a tobacco element 10 of a conventional cigarette structure has been substantiated by relatively simple tests. One such test comprised the draping of a piece of tissue paper such as ordinary facial tissue over a horizontally supported smoking device embodying this invention. With the cigarette or tobacco element 10 ignited and burning and the tissue paper placed over the outer surface of the protective shield 11, burning of the tobacco was then induced through normal inhalation and smoking procedure. As the tobacco element 10 was consumed, the burning zone Z traversed longitudinally of the device and the location thereof as could be ascertained by observing a slight discoloration of the tissue, but this did not result in the ignition of the facial tissue as there was insufficient heat transferred through the shield to the tissue. The discoloration was attributed to the combustion products and deemed caused by any heat produced scorching. The effectivity of a smoking device embodying this invention as would result if the device were merely placed on a table top or similar supporting surface was observed by supporting the device in a loop of the same facial tissue. Again, although the tobacco element 10 continued to burn, there was no real evidence that there was heat of any significant degree transferred to the supporting tissue paper. As a consequence of heat having a greater density to flow upwardly, there was not even a slight indication of scorching of the tissue paper supporting the device. As a further example of the ability of this device to avoid inadvertent ignition of other articles, burning cigarettes provided with the shield were dropped into containers filled with loose tissue paper and also onto various fabric articles such as upholstery, carpets and blanket-type materials associated with bed clothing. In all of these cases, the shield 11 provided a structurally self-supporting element that maintained the physical integrity of the device and prevented it from falling into crevices as in the case of carpet or bed clothing and additionally, provided an effective shield against transfer of heat to the surrounding materials as would effect ignition of those materials.

Figure 4:
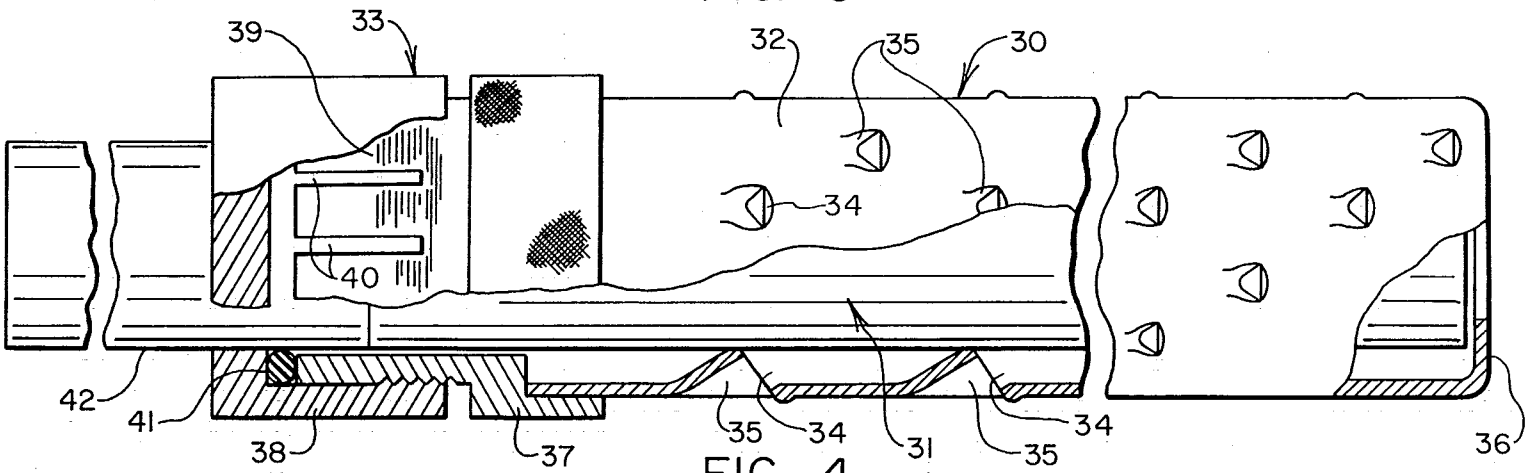
FIG. 4 is an elevational view of an embodiment of a modified form of the invention with portions thereof broken away for clarity of illustration.

A second embodiment of the invention is illustrated in the fragmentary sectional view of FIG. 4. This embodiment of the invention is designed to be formed as a reusable protective shield 30 which enables replacement of a conventional cigarette 31 within the shield. The shield 30 includes an elongated tube 32 provided with a connector 33 at one end for mechanically engaging with a cigarette and functioning to maintain the shield in fixed relationship to the cigarette. The elongated tube, as in the case of the first described embodiment, is of a thin walled construction provided with a multiplicity of the apertures 34 and associated projections 35. Also if desired, the one end of the tube 32 may be formed with an inturned lip 36 to function as described in connection with the first embodiment.

The connector 33 in this illustrated embodiment comprises a structure which functions similar to a collet-type chuck. Accordingly, the connector 33 is seen to include a base ring 37 which is fixedly secured to an end portion of the tube 32 and is provided with a clamp ring 38. The base ring 37 includes a collapsible ring section 39 having a number of longitudinally extending slots 40 formed around the circumference. The clamp ring 38 is of a cup shape and adapted to be threaded onto the collapsible ring section 39. Cooperative tapered surfaces of each of the elements result in the inward collapsing of the ring section 39 as the clamp ring is threaded onto the base ring. An air seal between the connector 33 and the cigarette is provided by means of a compressible circular ring 41. This ring 41 is positioned between opposed radial surfaces of the base and clamp rings 37 and 38. Functional operation of the connector is simply that unthreading of the clamp ring will release the collapsible ring section such that the fingers will move radially outward and release any cigarette that is retained therein or permit insertion of a cigarette through an aperture 42 which is formed in the clamp ring 38. It will be noted that the diameter of the aperture 42 is slightly greater than the diameter of the conventional cigarette and the internal diameter defined by the projections 35 is substantially equal to the diameter of such a cigarette. As a consequence, the projections 35 will be capable of supporting the cigarette in the desired position as well as supporting the ash that is formed during the combustion of the tobacco element.

While two specific embodiments of this invention have been illustrated and described, it will be readily apparent that this invention is not restricted to those specific structural configurations. The projections may be fabricated with different configurations and by techniques other than by the noted roll forming dies. Although the apertures are shown and described as having a small area component that lies in the same plane as the shield wall, it will be understood that this area component may be increased to or it may be eliminated entirely through use of modified fabricating techniques. Also, while the projections are shown with only one orientation with respect to the longitudinal axis, and which orientation is deemed advantageous, these projections could be oriented in an opposite direction with the apertures effectively opening in a direction from which the burning progresses.

It will be noted that the disposable embodiment has several additional advantages that are of an economic or commercial nature. The shield can be formed as an integral part of a smoking device combination including an essentially conventional cigarette, and thus, little is required to adapt present cigarette manufacture to production of cigarettes incorporating this invention. A smoking device incorporating this invention retains the familiar and acceptable size and configuration and may be marketed in the present type of packaging. As a matter of some importance, the smoking devices of this invention are utilized in substantially the same manner as conventional cigarettes, and thus, smokers' habits are not affected or disrupted except to advantage. A cigarette with a shield provides a container for the ash, thereby facilitating disposal and thereby avoiding the inconvenience of concurrent requirement of an ashtray to permit smoking. There are also cosmetic advantages obtained with this invention. One such advantage is the visual cleanliness in that external appearance remains the same after smoking, or during smoking for that matter. Also, by application of suitable exterior coatings, various visual effects may be achieved.

It will be readily apparent from the foregoing description of two illustrative embodiments of this invention that a smoking device is provided having a construction which greatly enhances safety in smoking of tobacco products. This invention contributes in a highly significant manner as to safety in that it can be embodied in structural combination with a tobacco device such as a conventional cigarette to form an integral unit that is of essentially the same size as a conventional cigarette and is thus capable of being packaged in the same manner and is utilized without requiring that the smoker take an active part in making use of the safety feature. With the disposable embodiment, the smoker, by merely purchasing cigarettes provided with the safety shield will thus utilize the safety features. While this invention promotes safety in smoking, it does not detract from the smoking function itself and the smoker will derive all of the pleasure from smoking as would be derived from smoking a cigarette that was not provided with this safety shield. The shield enables the free circulation of air to permit combustion of the tobacco without interference, but still provides an advantageous protective shield that very effectively contains the burning particles and prevents their contact with other combustible products. The shield is also highly effective in inhibiting transmission of heat to any objects with which the device may come into contact through the unique construction of the shield with its inwardly directed projections and apertures that provide little in the way of direct heat radiating paths to the surroundings.

Having thus described this invention, what is claimed:

1. A safety shield for use in combination with a tobacco article including a tobacco element of elongated, rod-like form having tobacco encased in a thin-walled, tubular sheath fabricated from a combustible material that is substantially impervious to airflow therethrough, the safety shield comprising an elongated, structurally self-supporting thin-walled tubular shield adapted to receive the tobacco element interiorly therein in axially extending relationship and in spaced relationship to an interior wall surface of said shield to thereby form an annular chamber therebetween extending substantially the coextensive length of the tobacco element and said shield, said chamber being closed at an end thereof adjacent the end of the tobacco element from which smoke is to be inhaled, said shield being formed from an essentially non-combustible material having a structural strength sufficient to remain self-supporting when subjected to heat generated by combustion of the tobacco element and including (a) a multiplicity of apertures formed in the wall thereof and distributed in relatively spaced relationship throughout substantially the entire shield wall that is coextensive with that portion of the tobacco element intended to be burned to enable passage of air and gaseous products of combustion therethrough relative to said annular space whereby air may freely circulate about the tobacco elements, and (b) a multiplicity of non-resilient projections formed as elongated portions of the wall of said tubular shield immediately adjacent said apertures, said projections having a terminal end edge extending a distance radially inward of the interior wall surface of said shield to contactingly engage with the tobacco element, said projections distributed throughout substantially the entire extent of the shield wall that is coextensive with that portion of the tobacco element intended to be burned for support of the tobacco element and ash residue formed by combustion thereof in spaced relationship to the interior wall surface of said shield and thereby forming said annular chamber, said projections being of a configuration forming a surface to guide the inflow of air for purposes of assisting combustion and the exhaust of gaseous combustion products.

2. A safety shield according to claim 1 including a plurality of ribs formed with the wall of said tubular shield and projecting in a direction relatively outward with respect to the exterior surface of the shield.

3. A safety shield according to claim 2 wherein each of said ribs defines a portion of the periphery of a respective aperture.

4. A safety shield according to claim 1 wherein each of said projections is formed from a portion of the wall of said tubular shield, said projection positoned relatively inward of the interior wall surface of said shield, said projection having a scoop-shaped configuration with the wall being severed to result in formation of a terminal end edge of each projection and defining of a respective aperture.

5. A safety shield according to claim 1 wherein said tubular shield includes releasable clamp means selectively operable to secure said shield in fixed relationship to a tobacco element received therein.

6. A tobacco article comprising (A) a tobacco element of elongated, rod-like form having tobacco encased in a thin-walled, tubular sheath, said sheath fabricated from a combustible material that is substantially impervious to airflow therethrough, (B) an elongated, structurally self-supporting thin-walled tubular shield adapted to receive the tobacco element interiorly therein in axially extending relationship and in spaced relationship to an interior wall surface of said shield to thereby form an annular chamber therebetween extending substantially the coextensive length of the tobacco element and said shield, said chamber being closed at an end thereof adjacent the end of the tobacco element from which smoke is to be inhaled, said shield being formed from an essentially non-combustible material having a structural strength sufficient to remain self-supporting when subjected to heat generated by combustion of the tobacco element and including (1) a multiplicity of apertures formed in the wall thereof and distributed in relatively spaced relationship throughout substantially the entire shield wall that is coextensive with that portion of the tobacco element intended to be burned to enable passage of air and gaseous products of combustion therethrough relative to said annular space whereby air may freely circulate about the tobacco element, and (2) a multiplicity of non-resilient projections formed as elongated portions of the wall of said tubular shield immediately adjacent said apertures, said projections having a terminal end edge extending a distance radially inward of the interior wall surface of said shield to contactingly engage with the tobacco element, said projections distributed throughout substantially the entire extent of the shield wall that is coextensive with that portion of the tobacco element intended to be burned for support of the tobacco element and ash residue formed by combustion thereof in spaced relationship to the interior wall surface of said shield and thereby forming said annular chamber, said projections being of a configuration forming a surface to guide the inflow of air for purposes of assisting combustion and the exhaust of gaseous combustion products, and (C) means for securing said tobacco element and said tubular shield in assembled relationship.

7. A tobacco article according to claim 6 which includes a filter element disposed adjacent to one end of said tobacco element in axially extending relationship whereby air and gaseous products of combustion may be drawn therethrough from said tobacco element.

8. A tobacco article according to claim 7 wherein a marginal end portion of said tubular shield extends in overlapped relationship to said filter element and a fluid seal is formed between said tobacco element and said shield to effectively close said annular chamber at the end thereof adjacent said filter element.

9. A safety shield for use in combination with a tobacco article including a tobacco element of elongated, rod-like form having tobacco encased in a thin-walled, tubular sheath fabricated from a combustible material that is substantially impervious to airflow therethrough, the safety shield comprising an elongated, structurally self-supporting thin-walled tubular shield adapted to receive the tobacco element interiorly therein in axially extending relationship and in spaced relationship to an interior wall surface of said shield to thereby form an annular chamber therebetween extending substantially the coextensive length of the tobacco element and said shield, said chamber being closed at an end thereof adjacent the end of the tobacco element from which smoke is to be inhaled, said shield being formed from an essentially non-combustible material having a structural strength sufficient to remain self-supporting when subjected to heat generated by combustion of the tobacco element and including (a) a multiplicity of apertures formed in the wall thereof to lie substantially in a plane oriented transversely to a longitudinal axis of said tubular shield, and distributed in relatively spaced relationship throughout substantially the entire shield wall that is coextensive with that portion of the tobacco element intended to be burned to enable passage of air and gaseous products of combustion therethrough relative to said annular space whereby air may freely circulate about the tobacco elements, and (b) a multiplicity of projections formed on said shield to extend a distance radially inward of the interior wall surface of said shield to contactingly engage with the tobacco element, said projections distributed throughout substantially the entire extent of the shield wall that is coextensive with that portion of the tobacco element intended to be burned for support of the tobacco element and ash residue formed by combustion thereof in spaced relationship to the interior wall surface of said shield and thereby forming said annular chamber.

10. A safety shield for use in combination with a tobacco article including a tobacco element of elongated, rod-like form having tobacco encased in a thin-walled, tubular sheath fabricated from a combustible material that is substantially impervious to airflow therethrough, the safety shield comprising an elongated, structurally self-supporting thin-walled tubular shield adapted to receive the tobacco element interiorly therein in axially extending relationship and in spaced relationship to an interior wall surface of said shield to thereby form an annular chamber therebetween extending substantially the coextensive length of the tobacco element and said shield, said chamber being closed at an end thereof adjacent the end of the tobacco element from which smoke is to be inhaled, said shield being formed from an essentially non-combustible material having a structural strength sufficient to remain self-supporting when subjected to heat generated by combustion of the tobacco element and including (a) a multiplicity of aperture formed in the wall thereof and distributed in relatively spaced relationship throughout substantially the entire shield wall that is coextensive with that portion of the tobacco element intended to be burned to enable passage of air and gaseous products of combustion therethrough relative to said annular space whereby air may freely circulate about the tobacco elements, and (b) a multiplicity of projections formed as elongated portions of the wall of said tubular shield and are of channel-shaped cross-section having a terminal end edge extending a distance radially inward of the interior wall surface of said shield to contactingly engage with the tobacco element, said projections distributed throughout substantially the entire extent of the shield wall that is coextensive with that portion of the tobacco element intended to be burned for support of the tobacco element and ash residue formed by combustion thereof in spaced relationship to the interior wall surface of said shield and thereby forming said annular chamber.

11. A safety shield according to claim 10 wherein each of said projections in cooperation with the wall of said tubular shield defines a respective one of said apertures, said terminal end edges thereof forming a portion of the periphery of the respective aperture.

12. A safety shield according to claim 11 wherein the remainder of the periphery of said apertures is formed in the wall of said tubular shield with the combined peripheral portions defining an aperture that lies substantially in a plane oriented transversely to a longitudinal axis of said tubular shield.

13. A safety shield according to claim 10 wherein said projections are each disposed with a longitudinal axis thereof lying in a plane substantially aligned in parallel relationship with a longitudinal axis of the tubular shield.

14. A safety shield according to claim 13 wherein said projections are integrally formed from the wall of said tubular shield and are separated therefrom only at said terminal end edge with their longitudinal axis inclined radially with respect to the longitudinal axis of said tubular shield.

15. A safety shield according of claim 14 wherein the channel shaped cross-section of said aperture is arcuately curved.

* * * * *